US011304485B1

(12) United States Patent
Coren et al.

(10) Patent No.: US 11,304,485 B1
(45) Date of Patent: Apr. 19, 2022

(54) BEZEL MAKING DEVICE

(71) Applicants: Dennis Coren, Huntington Valley, PA (US); Arthur Coren, Cathedral City, CA (US)

(72) Inventors: Dennis Coren, Huntington Valley, PA (US); Arthur Coren, Cathedral City, CA (US)

(73) Assignee: BezelEase LLC, Cheyenne, WY (US)

( * ) Notice: Subject to any disclaimer, the term of this patent is extended or adjusted under 35 U.S.C. 154(b) by 0 days.

(21) Appl. No.: 17/509,447

(22) Filed: Oct. 25, 2021

Related U.S. Application Data

(60) Provisional application No. 63/244,932, filed on Sep. 16, 2021.

(51) Int. Cl.

| | |
|---|---|
| ***B25B 11/00*** | (2006.01) |
| ***A44C 27/00*** | (2006.01) |
| ***B21D 53/44*** | (2006.01) |
| ***B25B 1/24*** | (2006.01) |
| ***B26B 29/06*** | (2006.01) |

(52) U.S. Cl.
CPC ..... *A44C 27/00* (2013.01); *B21D 53/44* (2013.01); *B25B 1/241* (2013.01); *B26B 29/06* (2013.01)

(58) Field of Classification Search
CPC ..... B25B 11/00; B25B 1/241; B25B 29/06; B23Q 3/00; B23Q 3/06
See application file for complete search history.

(56) References Cited

U.S. PATENT DOCUMENTS 4,900,586 A * 2/1990 Kanamori ..... H01C 17/281 427/430.1
5,387,287 A * 2/1995 Reiter ..... B05C 13/00 118/503
5,431,380 A * 7/1995 Vergato, Sr. ..... H02G 3/12 269/37
8,020,843 B2 * 9/2011 Wang ..... B25B 5/10 269/45
8,727,327 B2 * 5/2014 Miller ..... B25H 1/04 269/244
10,300,568 B2 * 5/2019 Kousens ..... B25B 1/2452
2009/0020937 A1 * 1/2009 Odell ..... B25B 1/2468 269/271

OTHER PUBLICATIONS

NPL—Cite No. 1—Website available at least as early as Nov. 8, 2019 at: https://www.etsy.com/listing/586842403/bezel-tool-set?ga_order=most_relevant&ga_search_type=all&ga_view_type=gallery&ga_search_query=jim+brandvik&ref=sr_gallery-1-1&frs=1.

* cited by examiner

*Primary Examiner* — Lee D Wilson
(74) *Attorney, Agent, or Firm* — Patentfile, LLC; Bradley C. Fach; Steven R. Kick

(57) ABSTRACT

A bezel making device is provided which may be used for the manufacture of fancy bezels, castellated bezels, serrated bezels, and other jewelry structures using a bezel material. In some embodiments, the device may include a front plate and a back plate. The front plate may have a first crenellated edge, the first crenellated edge having a plurality of first merlons and first crenels, in which each first merlon of the plurality of first merlons and first crenels is separated from an adjacent first merlon by a first crenel. The back plate may have a second merlon (preferably of a second crenellated edge having a plurality of second merlons and second crenels) and the bezel material may be held between the front plate and back plate by tensioning the bezel material between the plurality of first merlons and first crenels and the one or more second merlons.

18 Claims, 13 Drawing Sheets

BEZEL MAKING DEVICE

CROSS REFERENCE TO RELATED APPLICATIONS

This application claims priority to and the benefit of the filing date of U.S. Provisional Application No. 63/244,932, filed on Sep. 16, 2021, entitled "DEVICE FOR THE MANUFACTURE OF FANCY, CASTELLATED OR SERRATED BEZELS", which is hereby incorporated by reference in its entirety.

FIELD OF THE INVENTION

This patent specification relates to the field of devices for making jewelry bezels. More specifically, this patent specification relates to a device for the manufacture of fancy bezels, castellated bezels, serrated bezels, and other jewelry structures.

BACKGROUND

In fields such as jewelry-making or lapidary arts, various means are typically used to mount or hold a gemstone, cabochon, coin, or other object in place on a setting. Chief amongst these methods is the use of prongs or a bezel. While a prong setting typically uses a claw-type action to secure the stone or item, a bezel is typically a strip of metal that surrounds the entire circumference or perimeter of the item being mounted. A bezel setting is very secure and also helps protect the mounted item from potential damage. Bezels can vary in type and manufacture, however, many bezels have a series of serrations or castellations that are cut or scored into the material. The purpose of these serrations or castellations are to facilitate the shaping of the bezel material around the gemstone, cabochon, coin, or other object to be mounted in the setting and/or to create certain designs that may add visual interest to the completed piece.

Currently, there are a number of devices for manufacturing bezels. Some of these devices attempt to create the bezel by a tedious process of measuring, marking and cutting each slot by hand. Another device uses a gauge tool to measure one slot at a time, which the user then marks and cuts before repeating the process. Still, other devices claim to aid in the making of bezels but are barely more than making a bezel by hand. These devices fail to meet the needs of the industry because they are slow and often lack precision and consistency. Therefore, a need exists for novel devices which may be used for the manufacture of fancy bezels, castellated bezels, serrated bezels, and other jewelry structures.

BRIEF SUMMARY OF THE INVENTION

A bezel making device is provided which may be used for the manufacture of fancy bezels, castellated bezels, serrated bezels, and other jewelry structures using a bezel material. In some embodiments, the device may include a front plate and a back plate. The front plate may have a first crenellated edge, the first crenellated edge having a plurality of first merlons and first crenels, in which each first merlon of the plurality of first merlons and first crenels is separated from an adjacent first merlon by a first crenel. The back plate may have a second merlon, and the bezel material may be held between the front plate and back plate by tensioning the bezel material between the plurality of first merlons and first crenels and the second merlon.

In further embodiments, the device may include a front plate having a first crenellated edge, in which the first crenellated edge having a plurality of first merlons and first crenels. Each first merlon of the plurality of first merlons and first crenels may be separated from an adjacent first merlon by a first crenel. A back plate may have a second crenellated edge, the second crenellated edge having a plurality of second merlons and second crenels, in which each second merlon of the plurality of second merlons and second crenels is separated from an adjacent second merlon by a second crenel. A bezel material may be held between the front plate and back plate by tensioning the bezel material between the plurality of first merlons and first crenels and the plurality of second merlons and second crenels. The first crenels may be linearly aligned with the second crenels when the bezel material is tensioned between the plurality of first merlons and first crenels and the plurality of second merlons and second crenels.

BRIEF DESCRIPTION OF THE DRAWINGS

Some embodiments of the present invention are illustrated as an example and are not limited by the figures of the accompanying drawings, in which like references may indicate similar elements and in which.

DETAILED DESCRIPTION OF THE INVENTION

The terminology used herein is for the purpose of describing particular embodiments only and is not intended to be limiting of the invention. As used herein, the term "and/or" includes any and all combinations of one or more of the associated listed items. As used herein, the singular forms "a," "an," and "the" are intended to include the plural forms as well as the singular forms, unless the context clearly indicates otherwise. It will be further understood that the terms "comprises" and/or "comprising," when used in this specification, specify the presence of stated features, steps, operations, elements, and/or components, but do not preclude the presence or addition of one or more other features, steps, operations, elements, components, and/or groups thereof.

Unless otherwise defined, all terms (including technical and scientific terms) used herein have the same meaning as commonly understood by one having ordinary skill in the art to which this invention belongs. It will be further understood that terms, such as those defined in commonly used dictionaries, should be interpreted as having a meaning that is consistent with their meaning in the context of the relevant art and the present disclosure and will not be interpreted in an idealized or overly formal sense unless expressly so defined herein.

In describing the invention, it will be understood that a number of techniques and steps are disclosed. Each of these has individual benefit and each can also be used in conjunction with one or more, or in some cases all, of the other disclosed techniques. Accordingly, for the sake of clarity, this description will refrain from repeating every possible combination of the individual steps in an unnecessary fashion. Nevertheless, the specification and claims should be read with the understanding that such combinations are entirely within the scope of the invention and the claims.

Figure 2:
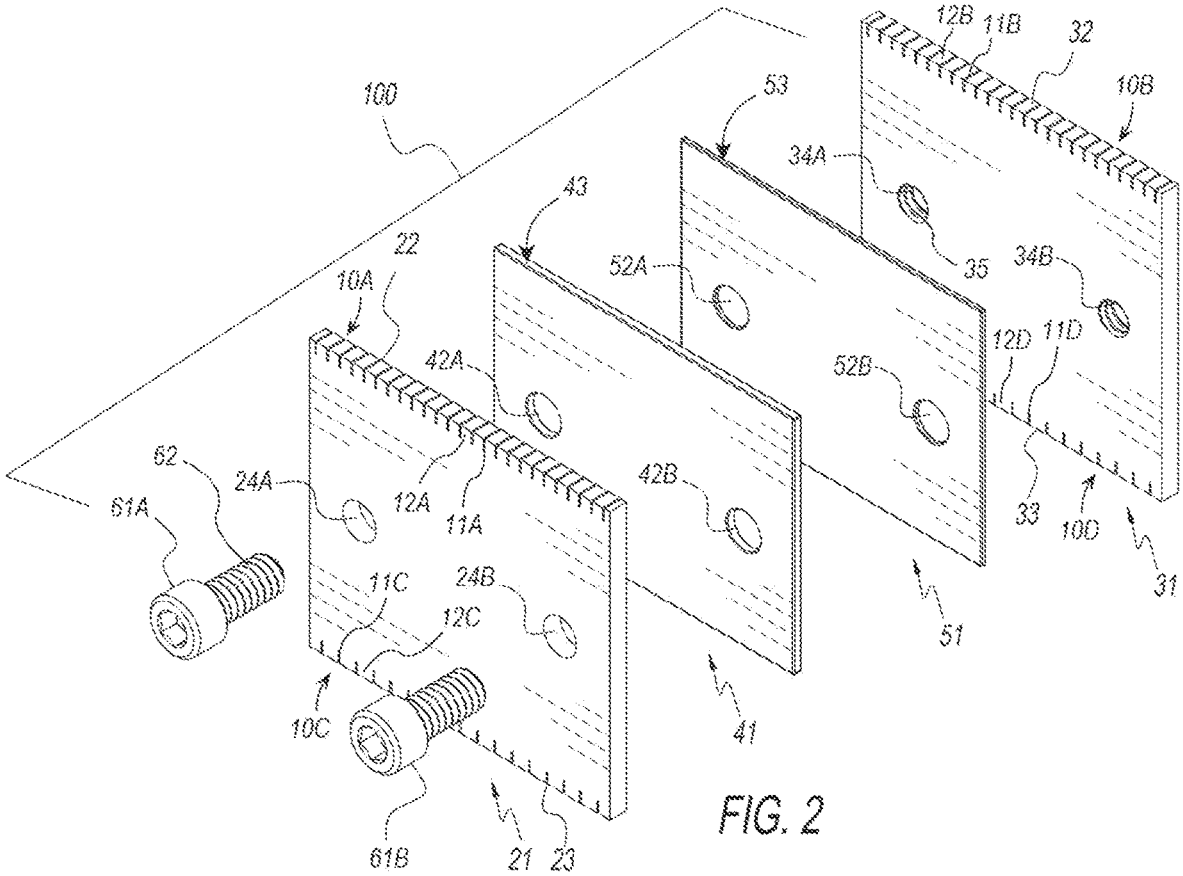
FIG. 2—FIG. 2 illustrates a perspective exploded view of an example of a bezel making device according to various embodiments described herein.
Figure 3:
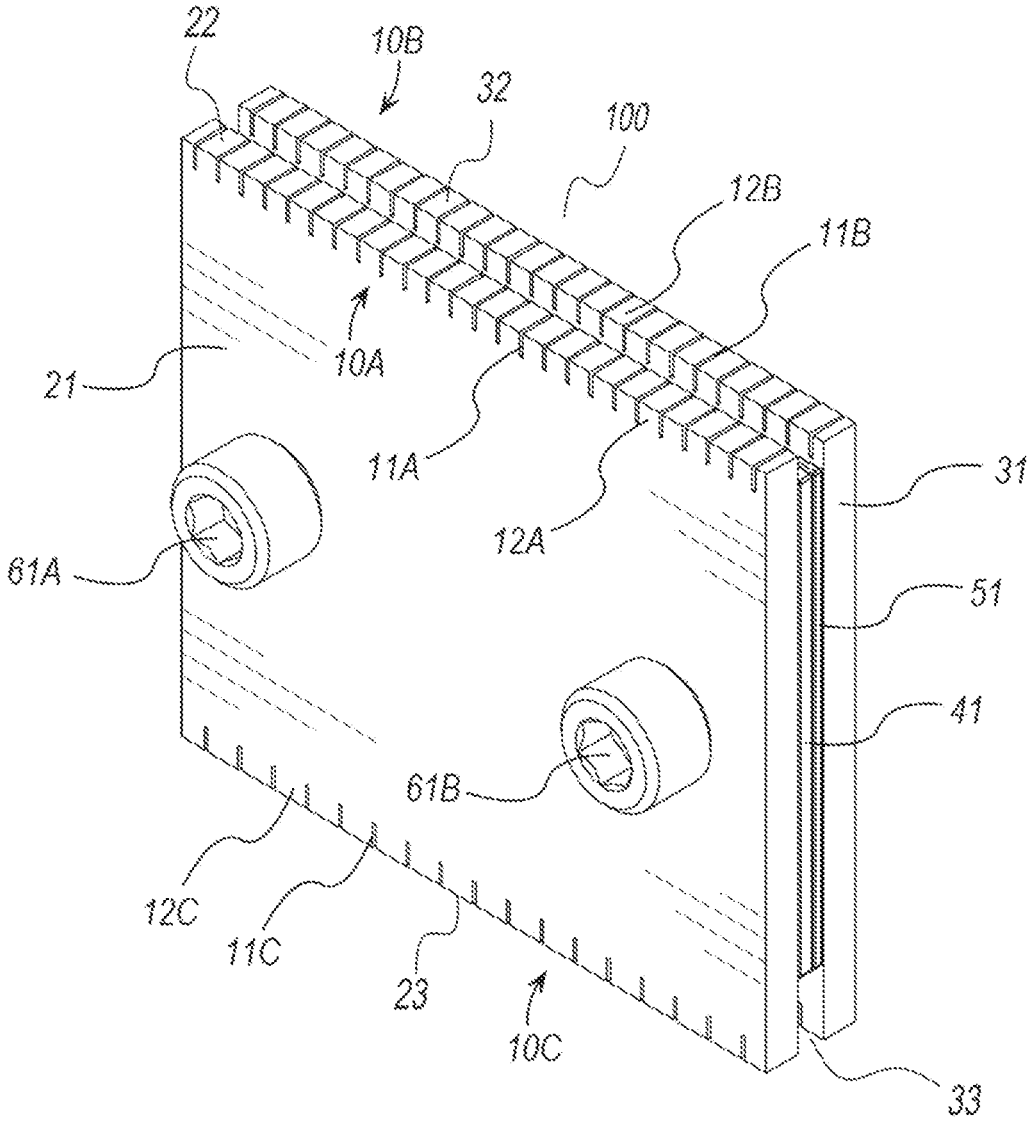
FIG. 3—FIG. 3 shows a perspective view of an example of a bezel making device according to various embodiments described herein.

For purposes of description herein, the terms "upper," "lower," "left," "right," "rear," "front," "side," "vertical," "horizontal," and derivatives thereof shall relate to the invention as oriented in FIGS. 2 and 3. However, one will understand that the invention may assume various alternative orientations and step sequences, except where expressly specified to the contrary. Therefore, the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Although the terms "first," "second," etc. are used herein to describe various elements, these elements should not be limited by these terms. These terms are only used to distinguish one element from another element. For example, the first element may be designated as the second element, and the second element may be likewise designated as the first element without departing from the scope of the invention.

As used in this application, the term "about" or "approximately" refers to a range of values within plus or minus 10% of the specified number. Additionally, as used in this application, the term "substantially" means that the actual value is within about 10% of the actual desired value, particularly within about 5% of the actual desired value and especially within about 1% of the actual desired value of any variable, element or limit set forth herein.

The following definitions will be used throughout the present application. The section captions and headings in this application are for convenience and reference purpose only and should not affect in any way the meaning or interpretation of this application. The technical terms and expressions used within the scope of this application are generally to be given the meaning commonly applied to them in the pertinent arts of jewelry-making, lapidary arts, metalsmithing and/or metalworking, if not otherwise indicated or amplified herein below. To help further explain the embodiments of the present invention, the following definitions of terms are provided.

"Setting": This general term typically refers to a metal base, channel, or prongs that surrounds and/or secures a gemstone, cabochon, coin, or other item to attach it to a piece of jewelry.

"Bezel Setting": This type of setting is characterized by a metal rim that precisely encircles the sides of a gemstone, cabochon, coin, or other item. The rim or collar can have straight or scalloped edges that stretch around the gem's entire perimeter or only around a portion of it, as in semi-bezel or half-bezel settings. In making a typical bezel setting, the bezel is shaped into the size and shape of the gem and then soldered into place on the metal of the jewelry. The prepared gemstone, cabochon, coin, or other item is then placed into the bezel and the metal is pressed around or down over the edges of stone, locking it into place.

"Bezel Material" refers to any metal, plastic, wax, or other material that may be cut or scored to form the bezel or a template or mold for a bezel or bezel casting.

"Castellated or Serrated Bezel" refers to a bezel that has been formed from bezel material that has been cut or scored at specific intervals to produce grooves, cuts, or slots on the material. These grooves, cuts, or slots may be for functional purposes, such as to bend or shape the material, and/or for decorative purposes. Other synonym less frequently used synonyms are are "crenellated bezel" or "fancy bezel".

"Crenel": This is a space or gap, such as a gap between two merlons or solid sections or a space or gap on either side of a merlon. This terminology derives from medieval architecture where castles had battlements which were formed by cutting crenels, i.e., grooves, slots, or gaps, into a previously solid and straight parapet wall. In this disclosure, the crenels are the grooves or slots where the user may insert a saw or other cutting device to cut or score the bezel material.

"Merlon": A portion of material adjacent to one or more crenels and extending above or machined into the perimeter edge, such as a solid width between two crenels. Generally, a merlon may comprise a projection while a crenel may comprise a lack of material or space adjacent to the merlon.

"Crenellated Edge": An edge having at least one merlon extending above or machined into the perimeter edge and adjacent to one or more crenels. Preferably, a crenellated edge may comprise a plurality of gaps (crenels) and solid portions/projections (merlons). A plurality of gaps (crenels) and solid portions (merlons) forming a crenellated edge is analogous to a "castellated edge" or "crenellated parapet" commonly used in medieval architecture or fortifications.

"Fastener": In the context of this disclosure, a fastener or mechanical fastener may be any screw, nail, nut, bolt, washer, anchor, stud, rivet, or magnet or similar device used to attach or assemble two or more pieces of the device. Fasteners may go into a threaded or non-threaded opening. In the latter case, a hardware nut, or cotter pin or other device may be used to provide a secure connection of the parts being assembled.

A new bezel making device is discussed herein. In the following description, for purposes of explanation, numerous specific details are set forth in order to provide a thorough understanding of the present invention. It will be evident, however, to one skilled in the art that the present invention may be practiced without these specific details.

The present disclosure is to be considered as an exemplification of the invention and is not intended to limit the invention to the specific embodiments illustrated by the figures or description below.

The present invention will now be described by example and through referencing the appended figures representing preferred and alternative embodiments. FIGS. 2-8, 11, 12, 15 and 16 perhaps best illustrate examples of a bezel making device ("the device") 100 according to various embodiments. In some embodiments, the device 100 may comprise a front plate 21 having a first crenellated edge 10A, and a back plate 31 having a second crenellated edge 10B. The first crenellated edge 10A may comprise a plurality of first merlons 12A and first crenels 11A, and each first merlon 12A of the plurality of first merlons 12A and first crenels 11A may be separated from an adjacent first merlon 12A by a first crenel 11A. The second crenellated edge 10B may comprise a plurality of second merlons 12B and second crenels 11B, and each second merlon 12B of the plurality of second merlons 12B and second crenels 11B may be separated from an adjacent second merlon 12B by a second crenel 11B. A bezel material 720 may be held between the front plate 21 and back plate 31 by tensioning the bezel material 720 between the plurality of first merlons 12A and first crenels 11A and the plurality of second merlons 12B and second crenels 11B, and one or more of the first crenels 11A may be linearly aligned with a second crenel 11B when the bezel material 720 may be tensioned between the plurality of first merlons 12A and first crenels 11A and the plurality of second merlons 12B and second crenels 11B.

The device 100 may comprise two or more plates 21, 31, such as a front plate 21 and a back plate 21. Preferably, the front plate 21 and back plate 21 may be constructed of or may comprise metal, plastic, or another rigid and durable material or a combination thereof. The device 100 may be polygonally-shaped, meaning that it has three or more sides, with at least one crenellated edge 10. In some embodiments, and as perhaps best shown in FIG. 3, the device 100 may comprise two rectangular prism shaped plates 21, 31, which when assembled may give the device 100 the shape of a four-sided polygon, rectangular in shape, with at least one plate 21, 31, having at least one crenellated edge 10. In preferred embodiments, the device 100 may comprise a front plate 21 and a back plate 31, and each plate 21, 31, may comprise at least one crenellated edge 10A, 10B, 10C, 10D. In alternative embodiments, the device 100 may comprise one or more plates 21, 31, having a triangular shape, a circular shape, a pentagonal shape, or any other shape, including a combination of shapes, so that the device 100 may be configured in any shape and size and having at least one crenelated edge 10.

Generally, each plate 21, 31, may comprise at least one merlon 12 and at least one crenel 11. Preferably, each plate 21, 31, may comprise at least two merlons 12 and at least one crenel 11 with the crenel 11 disposed between the two merlons 12. A crenel 11 may comprise a space, gap, cutout, depression, channel, slot or the like which may extend below a merlon 12. Generally, a crenel 11 may form a portion of the side of a plate 21, 31, having a merlon 12 that the merlon 12 extends above, and a merlon 12 may comprise a projection that is coupled to or formed into the plate 21, 31, that extends above the one or more crenels 11 of the plate 21, 31. In preferred embodiments, material of a plate 21, 31, may be removed from an edge of the plate 21, 31, in desired size(s) and shape(s), and preferably with a uniform size and shape, to form the crenels 11, and thereby also forming the merlons 12, of a crenellated edge 10. In other embodiments, material may be added to an edge of a plate 21, 31, in desired size(s) and shape(s), and preferably with a uniform size and shape, to form the merlons 12, and thereby also forming the crenels 11, of a crenellated edge 10. It should be understood that the suffixes of "A", "B", "C", etc., on the number of an element designate different embodiments of the element. For example, the crenellated edges 10A, 10B, 10C, 10D, etc., read on the teachings of crenellated edge 10.

As perhaps best depicted in FIGS. 2-5, 7, and 8, the device 100 may comprise one or more crenellated edges 10 which may comprise a series of alternating crenels 11 and merlons 12. In some embodiments, the device 100 may comprise a front plate 21 having a crenelated edge 10A and a back plate 31 having a single merlon 12 centrally located on an edge of the back plate 31 (therefore a crenel 11 is formed on either side of the single merlon 12), and the single merlon 12 on the back plate 31 may be used to press, clamp, or otherwise hold a bezel material 720 against the crenelated edge 10A of the front plate 21. In further embodiments, the device 100 may comprise a front plate 21 having a crenelated edge 10A and a back plate 31 having a two merlons 12 separated by a crenel 11, and the two merlons 12 on the back plate 31 may be used to press, clamp, or otherwise hold a bezel material 720 against the crenelated edge 10A of the front plate 21.

In preferred embodiments, the device 100 may comprise a front plate 21 having a first crenelated edge 10A and a back plate 31 having a second crenelated edge 10B, and the merlons 12B of the second crenelated edge 10B may be used to press, clamp, or otherwise hold a bezel material 720 against the merlons 12A of the first crenelated edge 10A. In further preferred embodiments, the device 100 may comprise a front plate 21 having a first crenelated edge 10A and third crenelated edge 10C, and a back plate 31 having a second crenelated edge 10B and fourth crenelated edge 10D so that a bezel material 720 may be pressed, clamped, or otherwise held between the first 10A and second 10B crenelated edges and/or between the third 10C and fourth 10D crenelated edges. In further embodiments, the device 100 may have three, five, six, seven, eight, or any number of crenelated edges 10.

As perhaps best shown in FIGS. 2, 3, 5, 7 and 8, in some embodiments, a front plate 21 may comprise two or more crenelated edges 10A, 10B, and a back plate 31 may likewise comprise two or more crenelated edges 10C, 10D. These plates 21, 31, may be rotated to provide the user access to the various spacing of crenels 1 and merlons 12. In further embodiments of a four-sided device 100, the device 100 may have one, two, three, or four crenellated edges 10, 10A, 10B, 10C, 10D. In other embodiments of a polygonally-shaped, meaning that it has three or more sides, the device 100 may have a minimum of one crenellated edge 10 and the maximum possible number of crenellated edges may be determined by the number of the sides of the polygon.

Figure 1:
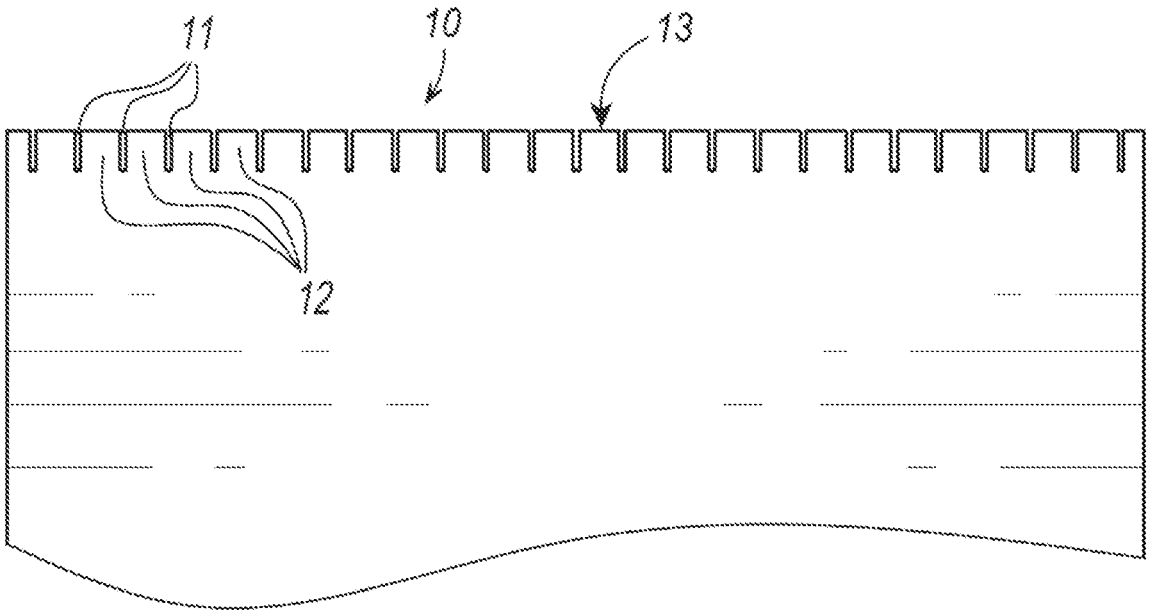
FIG. 1—FIG. 1 depicts a perspective view of an example of a crenellated edge according to various embodiments described herein.
Figure 4:
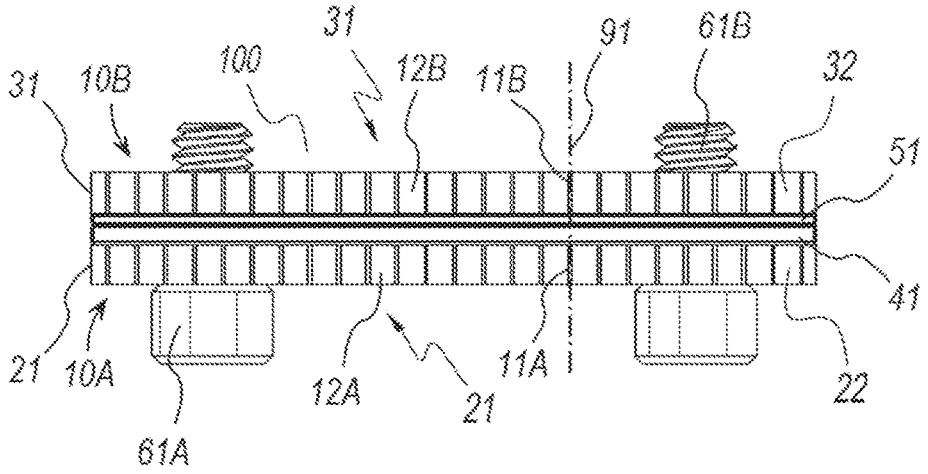
FIG. 4—FIG. 4 depicts a top plan view of an example of a bezel making device according to various embodiments described herein.
Figure 5:
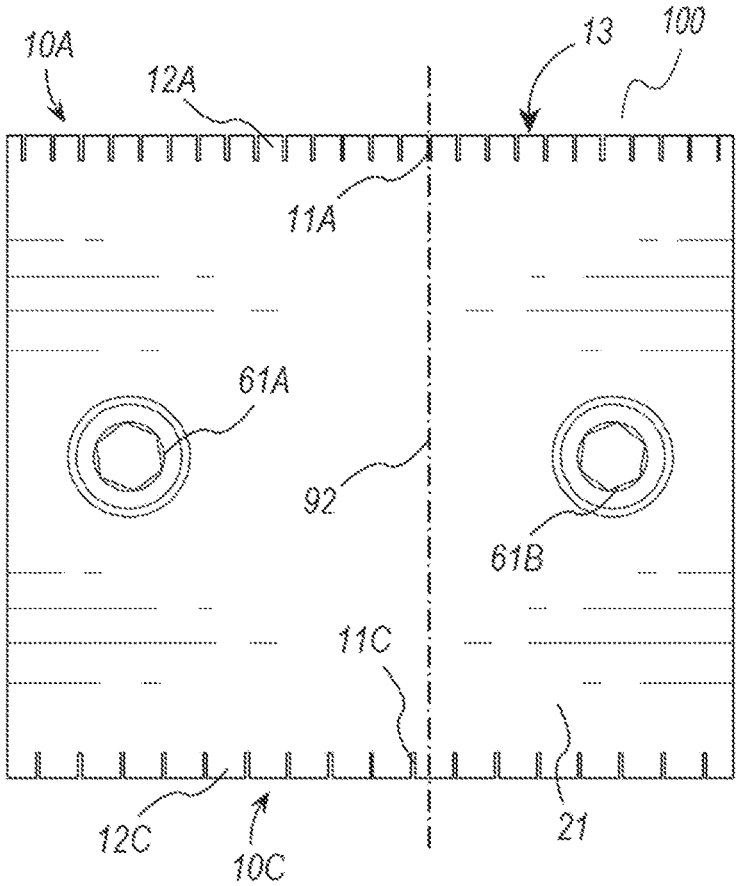
FIG. 5—FIG. 5 illustrates a front elevation view of an example of a bezel making device according to various embodiments described herein.

As perhaps best shown in FIGS. 1 and 4, the merlons 12 of a crenellated edge 10 may form a merlon surface 13. A merlon surface 13 may be formed by the portion of each merlon 12 that is most distal to the plate 21, 31, that it is coupled to. In preferred embodiments, and perhaps best shown in FIGS. 1 and 5, one or more, and more preferably each crenel 11 of a crenellated edge 10 may be substantially perpendicular (plus or minus 2 degrees) to the merlon surface 13 such that the crenels 11 are cut or formed substantially perpendicular (plus or minus 2 degrees) and below the merlon surface 13. In other embodiments, the crenels 11 of a crenelated edge 10 may be machined or formed at various angles to produce additional decorative and/or functional effects. In further embodiments, and perhaps best shown in FIG. 7, one or more, and more preferably each crenel 11 of a crenellated edge 10 may be angled (greater than 2 degrees relative to perpendicular) to the merlon surface 13 such that the crenels 11 are cut or formed be angled (greater than 2 degrees relative to perpendicular) and below the merlon surface 13.

In some embodiments, the device 100 may comprise a front plate 21 having a first crenelated edge 10A and a back plate 31 having a second crenelated edge 10B and one or more, and more preferably two or more, of the first crenels 11A of the first crenelated edge 10A may be linearly aligned with one or more, and more preferably two or more, of the second crenels 11B of the second crenelated edge 10B when a bezel material 720 is tensioned between the first crenelated edge 10A and second crenelated edge 10B. As perhaps best shown with axis line 91 in FIGS. 4 and 8, two crenels 11A, 11B, may be linearly aligned so that a saw blade or other linear cutting instrument of a cutting device 1200 may extend through the two crenels 11A, 11B, without bending or otherwise deforming the saw blade or other linear cutting instrument of a cutting device 1200. Preferably, when front plate 21 and the back plate 31 are placed next to each other or assembled with one or more optional spacer plates 41, 51, between, the crenels 11A, 11B, on the edges of the front 21 and back 31 plates align with each other and allow the user to insert a saw or other cutting device 120 to cut or score the bezel material 720 held by the device 100.

In some embodiments, the device 100 may comprise a front plate 21 having a first crenelated edge 10A and a third crenelated edge 10C and one or more, and more preferably two or more, of the first crenels 11A of the first crenelated edge 10A may not be linearly aligned with one or more, and more preferably two or more, of the third crenels 11C of the third crenelated edge 10C. As perhaps best shown with axis line 92 in FIG. 5 two crenels 11A, 11C, on a front plate 21 may be not linearly aligned such as by the first crenels 11A having a different number, shape, orientation, etc., than the third crenels 11C, and/or by the first merlons 12A having a different number, shape, orientation, etc., than the third merlons 12C. In this manner, the manipulating a cutting device 1200 through the first crenels 11A of the first crenelated edge 10A of a front plate 21 may produce a different number or pattern of cuts in a bezel material 720 than would be produced from manipulating a cutting device 1200 through the third crenels 11C of the third crenelated edge 10C of the front plate 21. Likewise, in some embodiments, the second crenels 11B of a second crenelated edge 10B of a back plate 31 may not be linearly aligned with one or more, and more preferably two or more, of the fourth crenels 11D of a fourth crenelated edge 10D of the back plate 31.

In some embodiments, the front plate 21 and back plate 31 may be removably coupled together. For example, the front plate 21 and back plate 31 may be magnetically coupled together, held together with an elastic band or strap, via adhesive, via a hook and loop fastener, other any other suitable removably coupling method.

In preferred embodiments, the front plate 21 and back plate 31 may be aligned and/or removably coupled together via one or more alignment studs 61A, 61B, which may be inserted through the front plate 21 and/or back plate 31 and any spacer plates 41, 51, which may be positioned between the front plate 21 and back plate 31. Preferably, one or more alignment studs 61A, 61B, may extend through at least one of the front plate and back plate when a bezel material 720 is tensioned between a first crenelated edge 10A and a second crenelated edge 10B so that the alignment stud(s) 61A, 61B, may linearly align the first 11A and second 11B crenels when the bezel material 720 is tensioned between the first crenelated edge 10A (plurality of first merlons 12A and first crenels 11A) and the second crenelated edge 10B (plurality of second merlons 12B and second crenels 11B).

Preferably an alignment stud 61A, 61B, may comprise a fastener or mechanical fastener such as a screw, nail, nut, bolt, washer, anchor, stud, rivet, or magnet or similar device used to attach or assemble two or more pieces of the device. Fasteners may go into a threaded or non-threaded opening. In the latter case, a hardware nut, or cotter pin or other device may be used with an alignment stud to provide a secure connection of the parts being assembled.

Optionally, a front plate 21 may comprise one or more front plate assembly and alignment apertures 24A, 24B, through which an alignment stud 61A, 61B, may be inserted through and/or a back plate 31 may comprise one or more back plate assembly and alignment apertures 34A, 34B, through which an alignment stud 61A, 61B, may be inserted through. Similarly, and optionally, a first spacer plate 41 may comprise one or more first spacer assembly and alignment apertures 42A, 42B, through which an alignment stud 61A, 61B, may be inserted through and/or a second spacer plate 51 may comprise one or more second spacer assembly and alignment apertures 52A, 52B, through which an alignment stud 61A, 61B, may be inserted through. Apertures 24A, 24B, 34A, 34B, 42A, 42B, 52A, 52B, may be configured in any size and shape, and more preferably configured to be just slightly than the portion of an inserted alignment stud 61A, 61B, to minimize movement of the inserted portion of the alignment stud 61A, 61B.

In some embodiments, an alignment stud 61A, 61B, may comprise a generally smooth shaft or projection which may be inserted through one or more apertures 24A, 24B, 34A, 34B, 42A, 42B, 52A, 52B. In further embodiments, an alignment stud 61A, 61B, may comprise threading 62. Optionally, threading 62 of an alignment stud 61A, 61B, may be used to threadedly couple a nut or other threaded fastener so that the front plate 21 and back plate 31 may be tensioned together by the alignment stud 61A, 61B, and threaded fastener. Optionally, a front plate 21 and/or back plate 31 may comprise threading 35 which may be used to threadedly couple an alignment stud 61A, 61B, so that the front plate 21 and back plate 31 may be tensioned together by the alignment stud 61A, 61B. In further embodiments, an alignment stud 61A, 61B, may comprise any type of fastener which may be suitable for positioning and/or tensioning a front plate 21 and back plate 31, along with other elements described herein, together.

In some embodiments, and as shown in FIG. 2 shows, the front plate assembly and alignment holes apertures 24A, 24B, may be smooth bored and the back plate assembly and alignment apertures holes 34A, 34B may be threaded 35, and optional spacer plates 41, 51, may also comprise smooth bored assembly and alignment apertures 42A, 42B, 52A, 52B. In this example, the device 100 may be assembled by passing the alignment studs 61A, 61B, through front plate assembly and alignment holes apertures 24A, 24B, and, if the user chooses to utilize one or more spacer plates 41, 51, through the first spacer assembly and alignment apertures holes 42A, 42B, and/or the second spacer assembly and alignment apertures holes 52A, 52B. The alignment studs 61A, 61B, are then secured in the back plate assembly and alignment apertures holes 34A, 34B. As described in this example, the assembled device 100 would resemble the views depicted in FIGS. 3-8. In other embodiments, the device 100 may contain all smooth bore apertures 24A, 24B, 34A, 34B, 42A, 42B, 52A, 52B and be assembled using a fastener and a nut. In further embodiments, fasteners may not be used, and the device 100 may be held together by use of a clamp or vise or similar device. In further embodiments, alignment stud 61A, 61B, fasteners may not be used, and the device 100 may be held together by magnetic attraction between one or more plates 21, 31, 41, 51.

Figure 8:
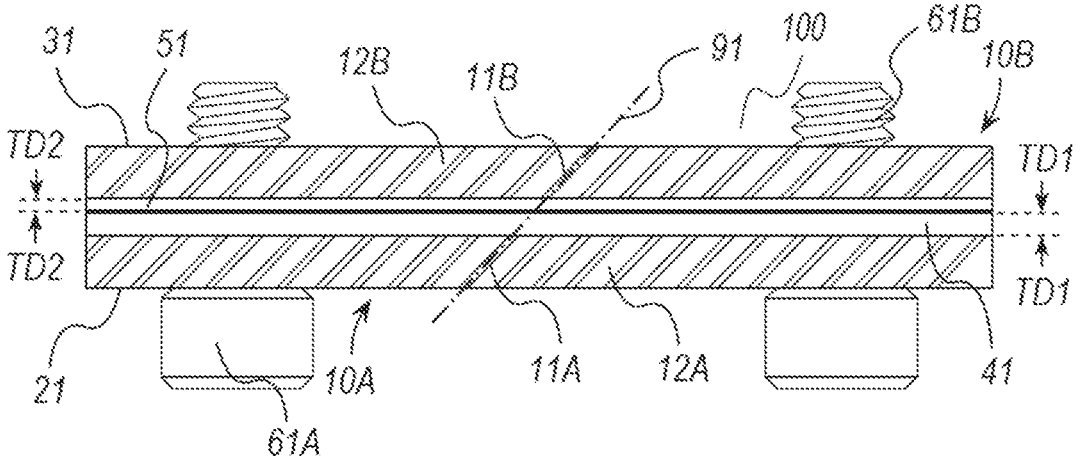
FIG. 8—FIG. 8 illustrates a top plan view of yet another example of a bezel making device according to various embodiments described herein.

Optionally, the device 100 may include one or more spacer plates 41, 51, which may be positioned between the front plate 21 and back plate 21 when a bezel material 720 is tensioned between a plurality of merlons 12A, 12C, and crenels 11A, 11C, of the front plate 21 and a plurality of merlons 12B, 12D, and crenels 11B, 11D, of the second plate 31. In preferred embodiments, the device 100 may comprise two spacer plates 41, 51, of different thicknesses or gauges. For example, and as shown in FIG. 8, the first spacer plate 41 may comprise a first thickness dimension (TD1), the second spacer plate 51 may comprise a second thickness dimension (TD2), and there may be greater than a five percent difference between TD1 and TD2 so that there may be greater than a five percent difference between the thickness or gauges of the spacer plates 41, 51.

Figure 6:
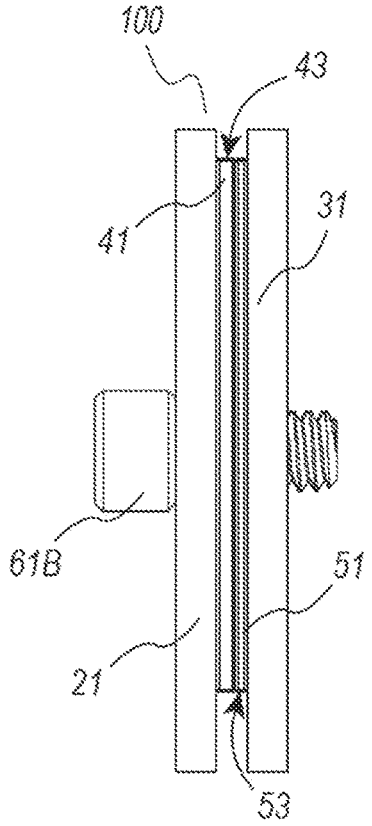
FIG. 6—FIG. 6 shows a side elevation view of an example of a bezel making device according to various embodiments described herein.
Figure 7:
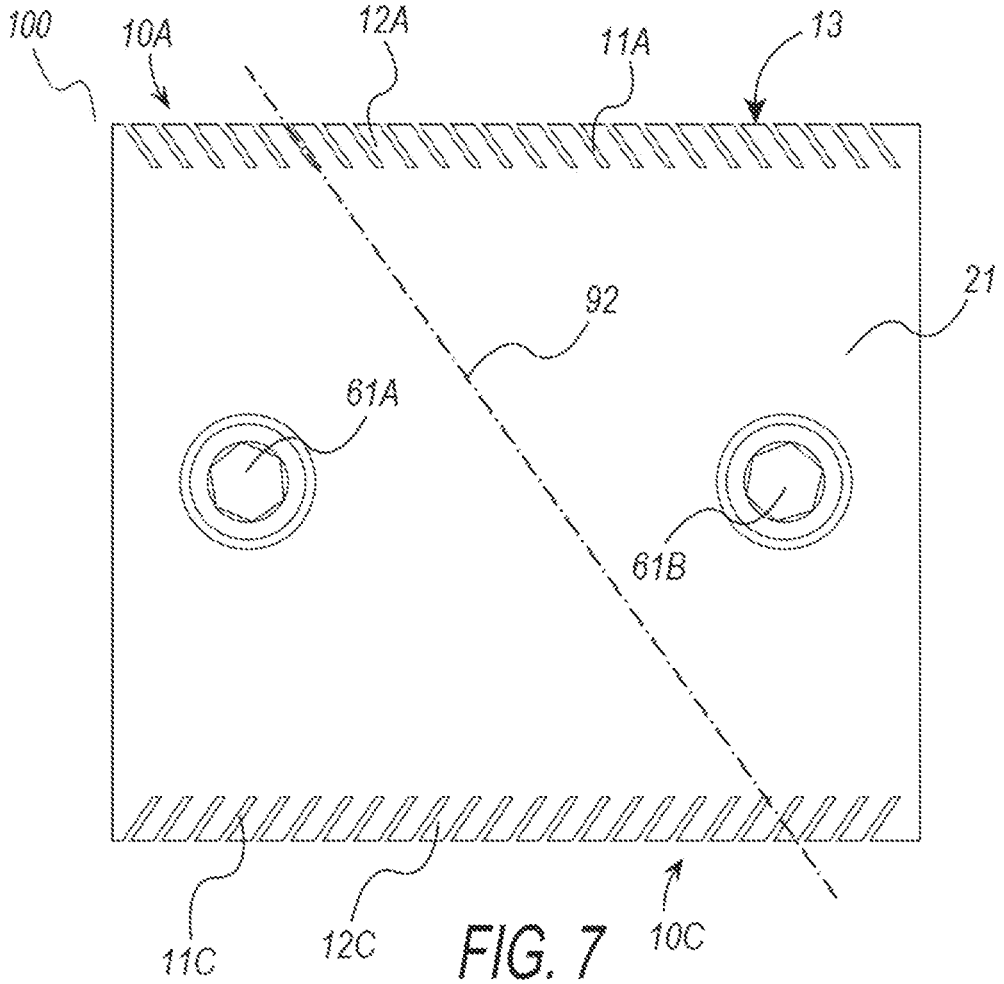
FIG. 7—FIG. 7 depicts a front elevation view of another example of a bezel making device according to various embodiments described herein.

When using the device 100, a user may choose to omit one or more spacer plates 41, 51, or they may be included singly or in combination to allow the user to work on thicker bezel materials, such as to form a ledge or shelf that supports the bezel material 720 when held between the front plate 21 and back plate 31. Generally, a first spacer plate 41 may comprise a first supporting surface 43 (FIG. 6) that may be formed by the perimeter of the spacer plate 41 as it is positioned proximate to a crenellated edge 10, 10A, 10B, 10C, 10D, of the device 100. Likewise, a second spacer plate 51 may comprise a second supporting surface 53 (FIG. 6) that may be formed by the perimeter of the spacer plate 51 as it is positioned proximate to a crenellated edge 10, 10A, 10B, 10C, 10D, of the device 100. By positioning one or more spacer plates 41, 51, between the front 21 and back 31 plates, one or more supporting surfaces 43, 53, preferably of different thicknesses may form a ledge or shelf that supports the bezel material 720 when held between the front plate 21 and back plate 31. In preferred embodiments, and as shown in FIG. 6, the supporting surfaces 43, 53, of the spacer plates 41, 51, may be positioned below the merlon surface 13 of at least one of the front 21 and back 31 plates, and more preferably below each merlon surface 13 of the front 21 and back 31 plates. Other embodiments may include three or more spacer plates of similar or differing thicknesses to provide the user with additional flexibility to accommodate and support various materials.

Figure 9:
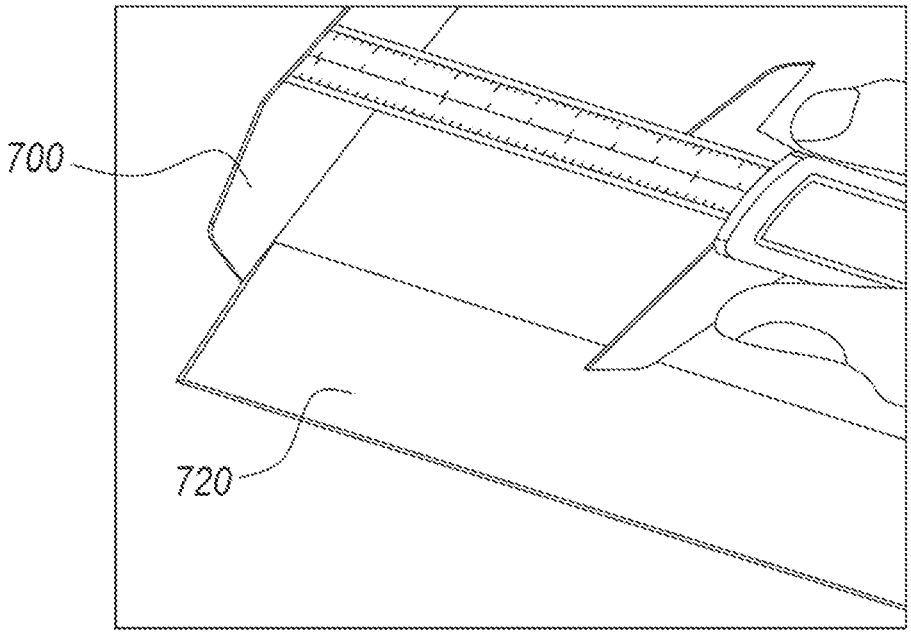
FIG. 9—FIG. 9 shows a perspective view of an example of a user measuring bezel making material according to various embodiments described herein.

The device 100 may be used to manufacture of fancy bezels, castellated bezels, serrated bezels, and other jewelry structures according to the examples shown in FIGS. 9-21. Once a user identifies the item for which a bezel will be produced, they will typically select an appropriate bezel material 720, and, if required, they will measure and cut the bezel material 720. An example is shown in FIG. 9 where a user is employing calipers 700 to measure the bezel material 720. Individuals knowledgeable in the pertinent arts of jewelry-making, lapidary arts, metalsmithing and/or metalworking will also recognize other techniques related to the use of measuring bezel materials.

Figure 10:
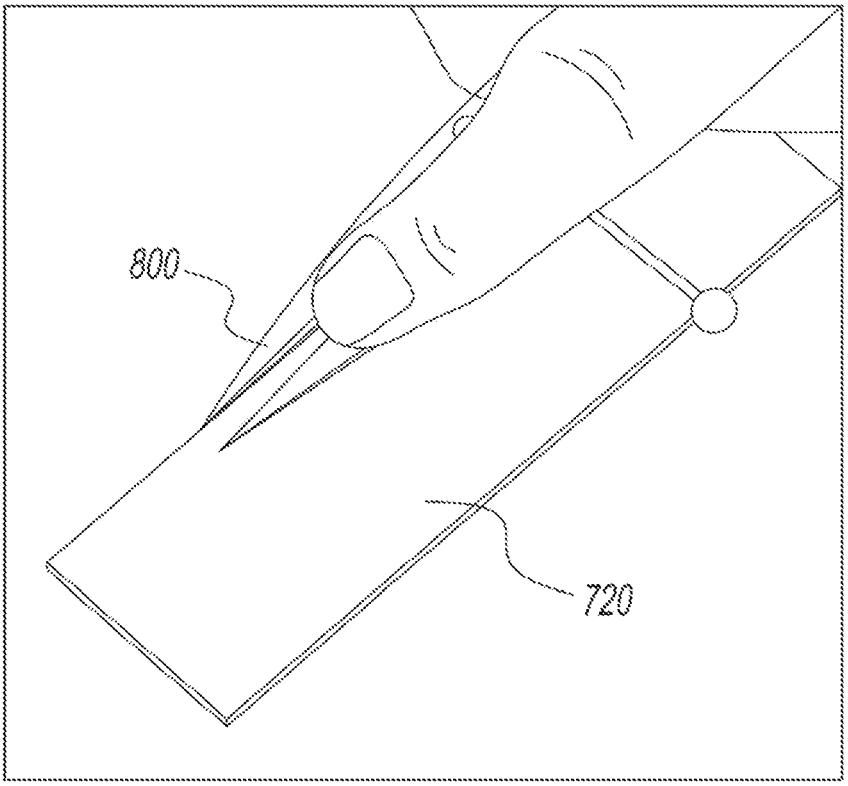
FIG. 10—FIG. 10 depicts a perspective view of an example of a user cutting bezel making material according to various embodiments described herein.

FIG. 10 shows a metal shears 800 cutting the bezel material 720. Other devices and techniques for cutting or trimming bezel materials 720 will also be employed by individuals knowledgeable in the pertinent arts of jewelry-making, lapidary arts, metalsmithing and/or metalworking.

It is also recognized that many materials suitable for making bezels and jewelry will already exist in appropriate dimensions or formats and not require the techniques depicted in FIGS. 9 and 10.

Figure 11:
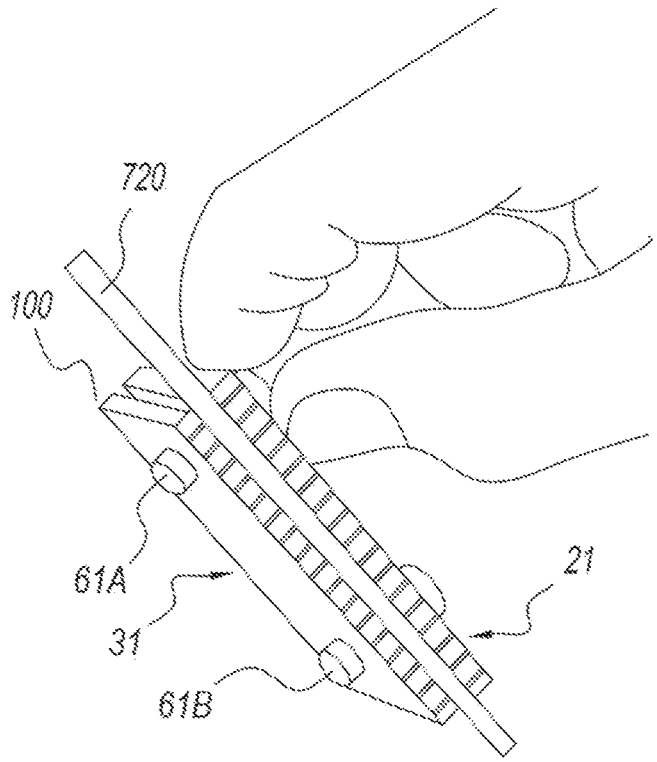
FIG. 11—FIG. 11 illustrates a perspective view of an example of a user securing bezel making material in a bezel making device according to various embodiments described herein.
Figure 12:
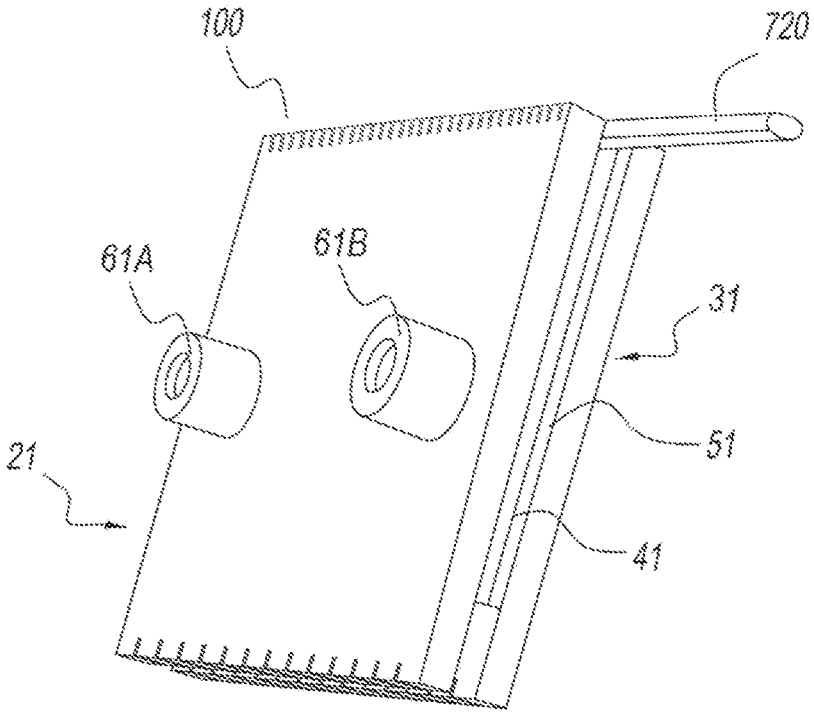
FIG. 12—FIG. 12 shows a perspective view of an example of a bezel making material secured in a bezel making device according to various embodiments described herein.

After deciding which spacer plate(s) 41, 51, to use, if any, the user then inserts the bezel material 720 into the device 100 and, in this embodiment, uses threaded alignment studs 61A, 61B, to secure it in place between a first crenelated edge 10A on a front plate 21 and at least one merlon 12B of a back plate 31, and more preferably between a merlon 12B of a second crenelated edge 10B of a back plate 31 as shown in FIG. 11. In this particular embodiment, as seen in FIG. 12, two spacer plates 41, 51, have been inserted and form a ledge or shelf (via the supporting surfaces 43, 53) that helps support the bezel material 720 between the front 21 and back 31 plates.

Figure 13:
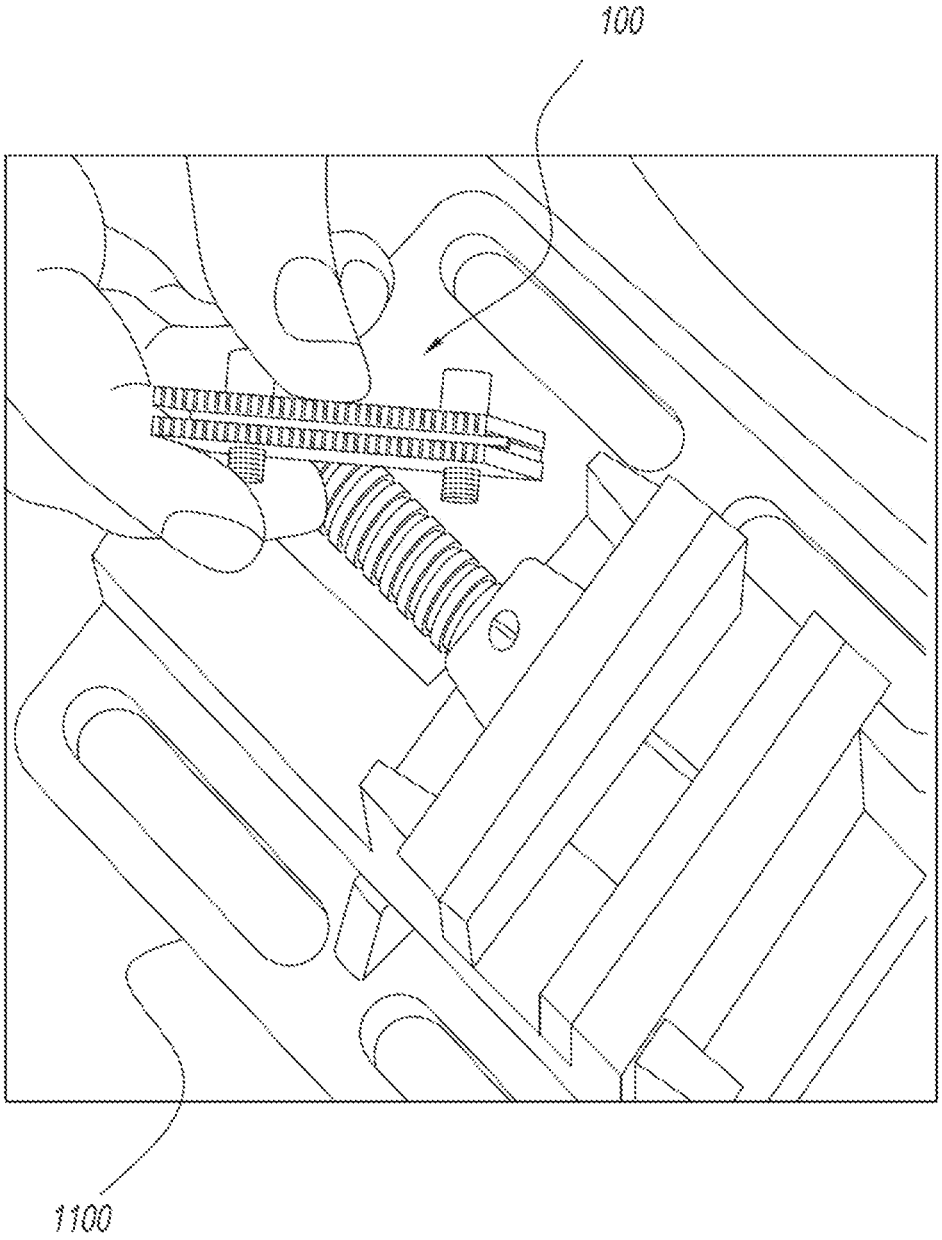
FIG. 13—FIG. 13 depicts a perspective view of an example of a user placing a bezel making device in a vise according to various embodiments described herein.
Figure 14:
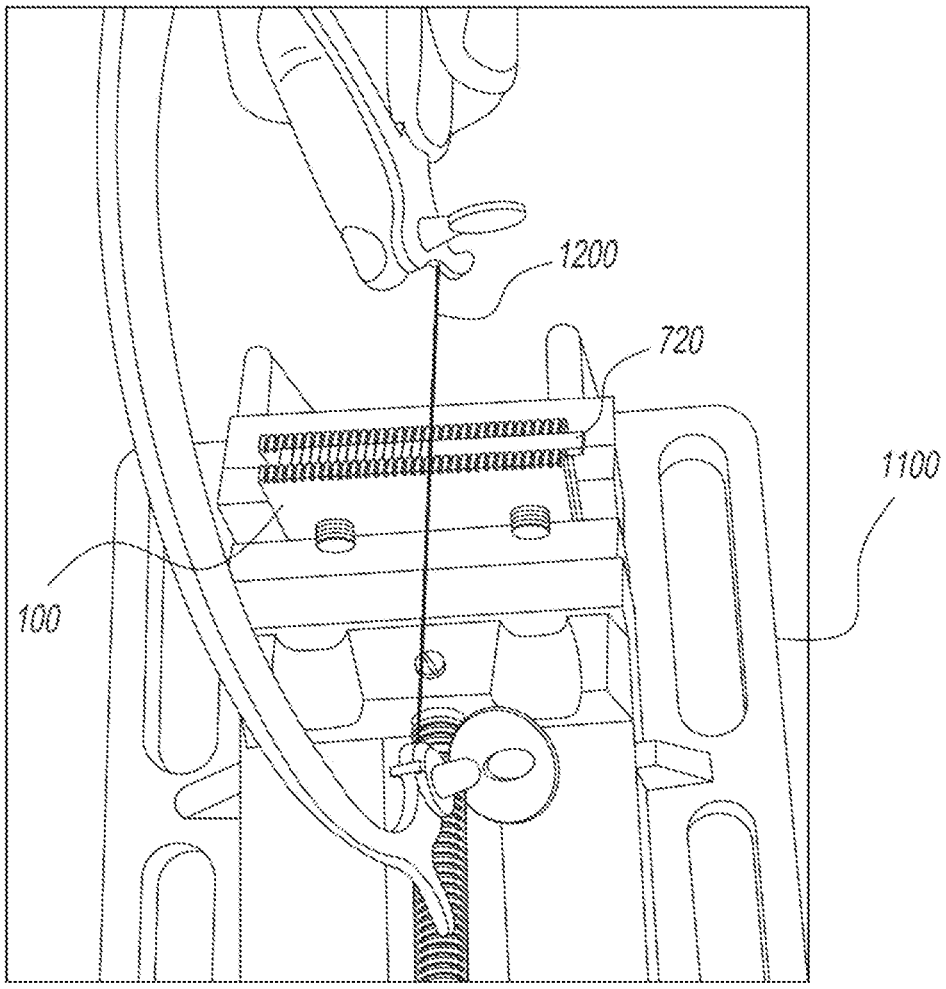
FIG. 14—FIG. 14 illustrates a perspective view of an example of a user using cutting device to score or cut bezel making material according to various embodiments described herein.

The device 100 may be stabilized and used by holding it in hand, or by use of a clamp or vise 1100 or similar device as shown in FIG. 13 and FIG. 14. The depicted clamp or vise 1100 is an example, however a wide variety of suitable clamps and vises are commercially available. In further embodiments, the device 100 may have its own compatible or integrated stand for stabilization and use.

The user then utilizes a saw, a blade or another cutting device 1200 which is inserted into the crenels 11A, 11B, to make cuts or scores at the desired intervals and or depths. FIG. 14 demonstrates one such cutting device 1200 cutting the Bezel Material 720. Individuals knowledgeable in the pertinent arts of jewelry-making, lapidary arts, metalsmithing and/or metalworking may also recognize other techniques and devices for cutting or scoring bezel making materials 720.

Figure 15:
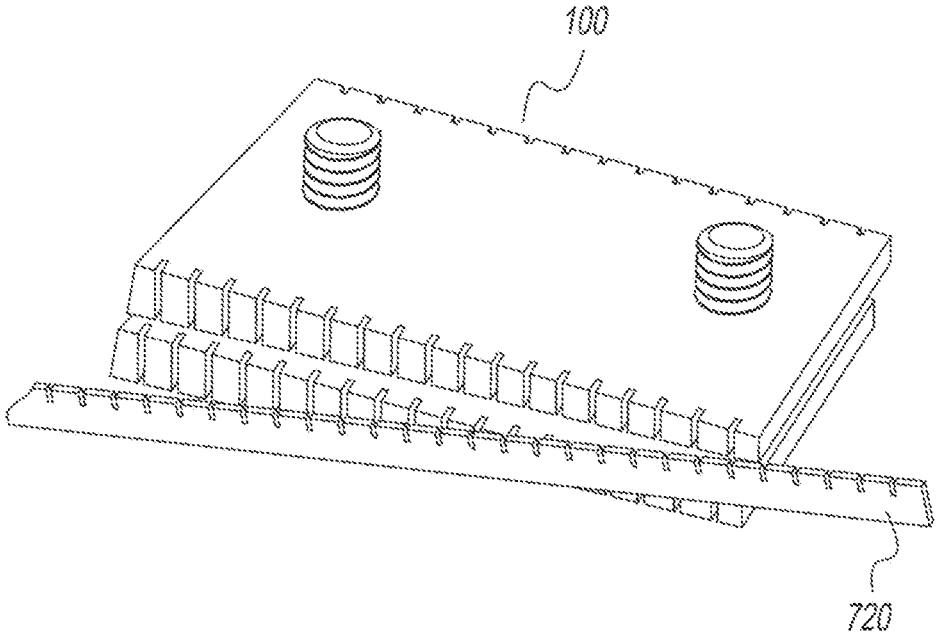
FIG. 15—FIG. 15 shows a perspective view of an example of a rotated cut or scored bezel making material after removal from a bezel making device according to various embodiments described herein.
Figure 16:
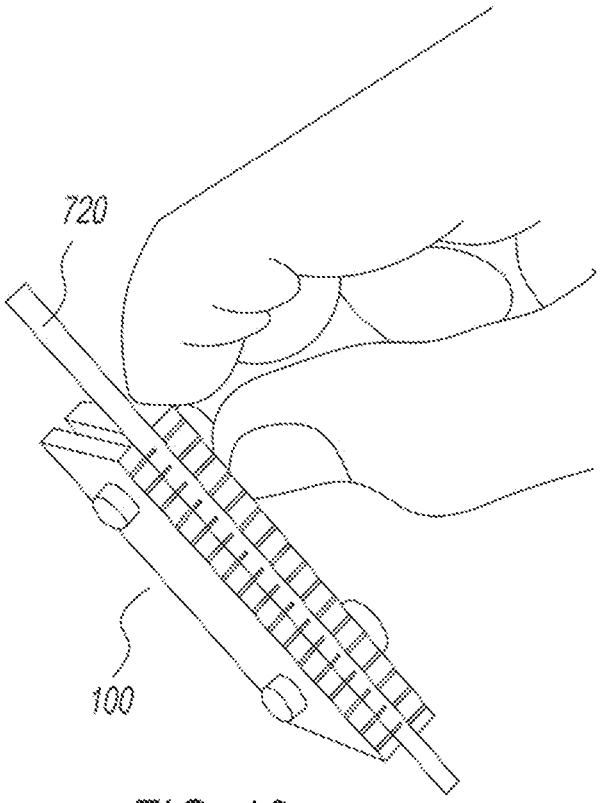
FIG. 16—FIG. 16 depicts a perspective view of an example of a cut or scored bezel making material in a bezel making device according to various embodiments described herein.

The scored or cut bezel material 720 is removed from the device 100 and, depending upon the user's needs, may not require additional processing. However, in most cases, the bezel material 720 will typically be rotated 90 or 270 degrees as seen in FIG. 15 and is reinserted into the device 100 with the previously sawn cuts or grooves aligned with a corresponding crenellated edge 10A, 10B, on the device 100 as depicted in FIG. 16.

Figure 17:
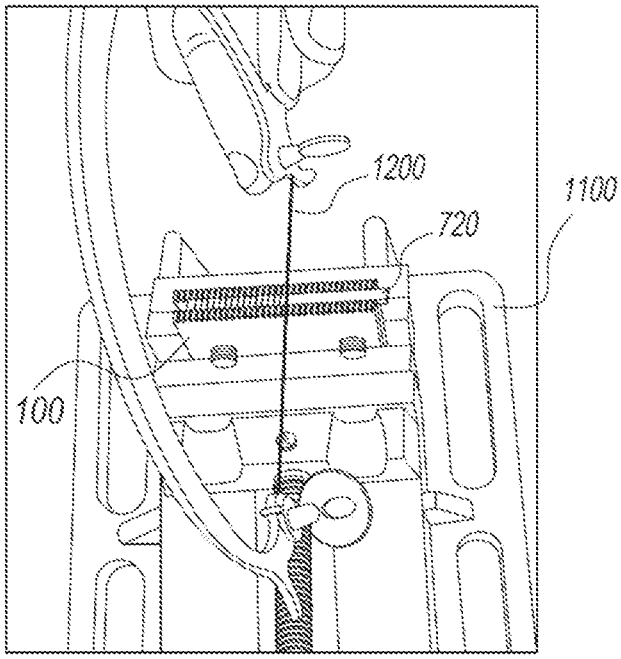
FIG. 17—FIG. 17 illustrates a perspective view of an example of a user using cutting device to score or cut bezel making material in a bezel making device perpendicular plane of bezel making material according to various embodiments described herein.

Similar to the technique outlined earlier, FIG. 17 of this disclosure shows the user employing the saw or cutting device 1200 to make the desired grooves or cuts on the perpendicular face of the bezel material 720. The bezel material 720 is secured in the device 100 and, in this demonstration, the device 100 is secured in a clamp 1100.

Figure 18:
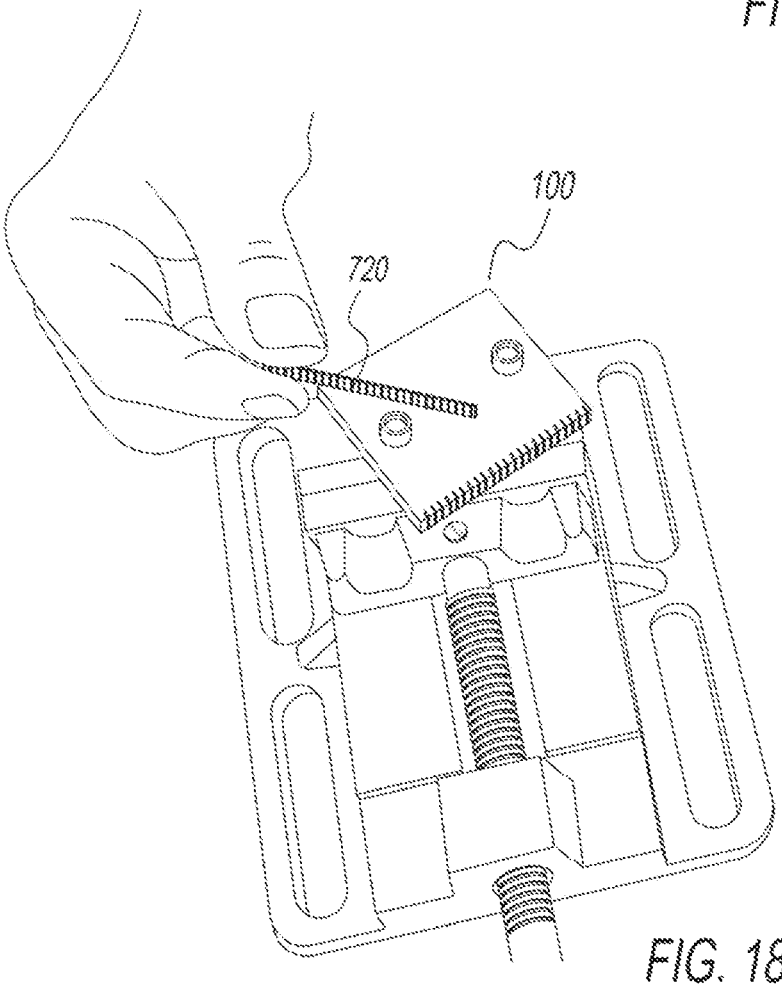
FIG. 18—FIG. 18 shows a perspective view of an example of a scored or cut bezel material removed from bezel making device according to various embodiments described herein.

After all the desired cuts and/or scores are complete, the user removes the bezel material 720 from the device shown in FIG. 18.

Figure 19:
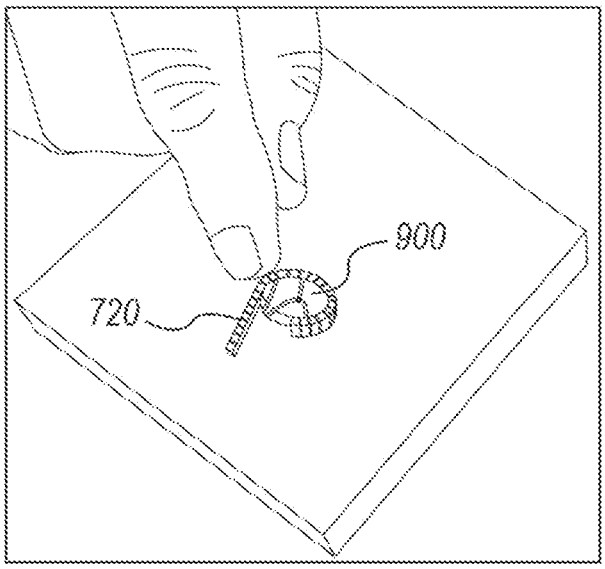
FIG. 19—FIG. 19 depicts a perspective view of an example of a user shaping the scored or cut bezel making material around an item to be bezel mounted, such as a cabochon according to various embodiments described herein.
Figure 20:
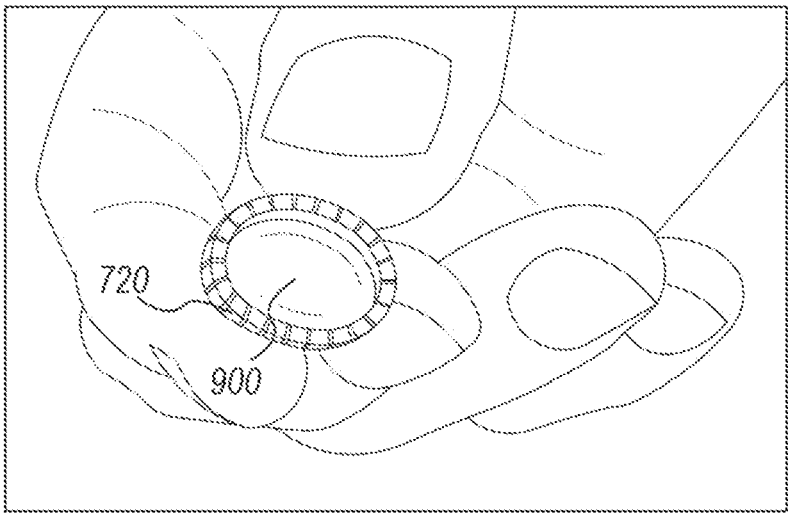
FIG. 20—FIG. 20 illustrates a perspective view of an example of a completed castellated bezel setting according to various embodiments described herein.

Using techniques that are familiar to those knowledgeable in the pertinent arts of jewelry-making, lapidary arts, metalsmithing and/or metalworking, the bezel material 720 is then shaped around the item to be bezel mounted 900, e.g., gemstone, cabochon, coin, or other item to be mounted in the setting as shown in FIG. 19 and trimmed soldered or otherwise secured to form the completed setting as in FIG. 20.

Figure 21:
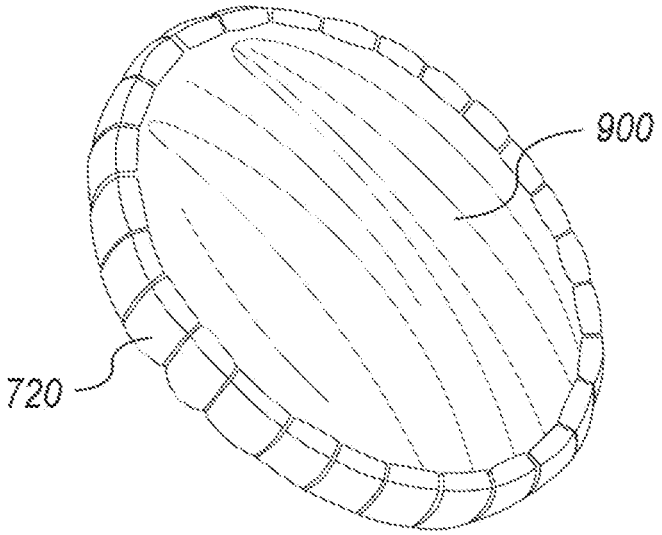
FIG. 21—FIG. 21 shows a perspective view of an example of a completed castellated bezel setting with mounted item, such as a cabochon according to various embodiments described herein.

FIG. 21 illustrates an example of a completed item, having an item to be bezel mounted 900 and bezel formed of a bezel making material 720, produced by using the device 100 and techniques similar to those described above.

While some exemplary shapes and sizes have been provided for elements of the device 100, it should be understood to one of ordinary skill in the art that the front plate 21, back plate 31, optional spacer plates 41, 51, alignment studs 61A, 61B, and any other element described herein may be configured in a plurality of sizes and shapes including "T" shaped, "X" shaped, square shaped, rectangular shaped, cylinder shaped, cuboid shaped, hexagonal prism shaped, triangular prism shaped, or any other geometric or non-geometric shape, including combinations of shapes. It is not intended herein to mention all the possible alternatives, equivalent forms or ramifications of the invention. It is understood that the terms and proposed shapes used herein are merely descriptive, rather than limiting, and that various changes, such as to size and shape, may be made without departing from the spirit or scope of the invention.

Additionally, while some materials have been provided, in other embodiments, the elements that comprise the device 100 may be made from or may comprise durable materials such as aluminum, steel, other metals and metal alloys, wood, hard rubbers, hard plastics, fiber reinforced plastics, carbon fiber, fiber glass, resins, polymers or any other suitable materials including combinations of materials. Additionally, one or more elements may be made from or may comprise durable and slightly flexible materials such as soft plastics, silicone, soft rubbers, or any other suitable materials including combinations of materials. In some embodiments, one or more of the elements that comprise the device 100 may be coupled or connected together with heat bonding, chemical bonding, adhesives, clasp type fasteners, clip type fasteners, rivet type fasteners, threaded type fasteners, other types of fasteners, or any other suitable joining method. In other embodiments, one or more of the elements that comprise the device 100 may be coupled or removably connected by being press fit or snap fit together, by one or more fasteners such as hook and loop type or Velcro® fasteners, magnetic type fasteners, threaded type fasteners, sealable tongue and groove fasteners, snap fasteners, clip type fasteners, clasp type fasteners, ratchet type fasteners, a push-to-lock type connection method, a turn-to-lock type connection method, a slide-to-lock type connection method or any other suitable temporary connection method as one reasonably skilled in the art could envision to serve the same function. In further embodiments, one or more of the elements that comprise the device 100 may be coupled by being one of connected to and integrally formed with another element of the device 100.

Although the present invention has been illustrated and described herein with reference to preferred embodiments and specific examples thereof, it will be readily apparent to those of ordinary skill in the art that other embodiments and examples may perform similar functions and/or achieve like results. All such equivalent embodiments and examples are within the spirit and scope of the present invention, are contemplated thereby, and are intended to be covered by the following claims.

What is claimed is:

1. A bezel making device for holding a bezel material, the device comprising:

a front plate having a first crenellated edge, the first crenellated edge having a plurality of first merlons and first crenels, wherein each first merlon of the plurality of first merlons and first crenels is separated from an adjacent first merlon by a first crenel;

a back plate having a second merlon, wherein the bezel material is held between the front plate and back plate by tensioning the bezel material between the plurality of first merlons and first crenels and the second merlon; and an alignment stud that extends through at least one of the front plate and back plate when the bezel material is tensioned between the plurality of first merlons and first crenels and the plurality of second merlons and second crenels.

2. The device of claim 1, wherein the back plate comprises a second crenellated edge, the second crenellated edge having a plurality of second merlons and second crenels, wherein each second merlon of the plurality of second merlons and second crenels is separated from an adjacent second merlon by a second crenel; and wherein a bezel material is held between the front plate and back plate by tensioning the bezel material between the plurality of first merlons and first crenels and the plurality of second merlons and second crenels, and wherein the first crenels are linearly aligned with the second crenels when the bezel material is tensioned between the plurality of first merlons and first crenels and the plurality of second merlons and second crenels.

3. The device of claim 1, wherein the first merlons form a first merlon surface, and wherein each first crenel is substantially perpendicular to the first merlon surface.

4. The device of claim 1, wherein the alignment stud comprises threading.

5. The device of claim 1, wherein the alignment stud is threadedly coupled to at least one of the front plate and back plate.

6. The device of claim 1, further comprising a first spacer plate that is positioned between the front plate and back plate when the bezel material is tensioned between the plurality of first merlons and first crenels and the plurality of second merlons and second crenels.

7. The device of claim 6, wherein the first merlons form a first merlon surface, wherein the first spacer plate comprises a first supporting edge, and wherein the first supporting edge is positioned below the first merlon surface when the bezel making material is tensioned between the plurality of first merlons and first crenels and the plurality of second merlons and second crenels.

8. The device of claim 6, further comprising a second spacer plate that is positioned between the front plate and back plate when the bezel material is tensioned between the plurality of first merlons and first crenels and the plurality of second merlons and second crenels, wherein the first spacer plate comprises a first thickness dimension (TD1), wherein the second spacer plate comprises a second thickness dimension (TD2), and wherein there is greater than a five percent difference between TD1 and TD2.

9. The device of claim 1, wherein the front plate comprises a third crenellated edge, the third crenellated edge having a plurality of third merlons and third crenels, and wherein the back plate comprises a fourth crenellated edge, the fourth crenellated edge having a plurality of fourth merlons and fourth crenels.

10. The device of claim 9, wherein the first crenels are not linearly aligned with the third crenels.

11. A bezel making device for holding a bezel material, the device comprising:

a front plate having a first crenellated edge, the first crenellated edge having a plurality of first merlons and first crenels, wherein each first merlon of the plurality of first merlons and first crenels is separated from an adjacent first merlon by a first crenel;

back plate having a second crenellated edge, the second crenellated edge having a plurality of second merlons and second crenels, wherein each second merlon of the plurality of second merlons and second crenels is separated from an adjacent second merlon by a second crenel; wherein the bezel material is held between the front plate and back plate by tensioning the bezel material between the plurality of first merlons and first crenels and the plurality of second merlons and second crenels, and wherein the first crenels are linearly aligned with the second crenels when the bezel material is tensioned between the plurality of first merlons and first crenels and the plurality of second merlons and second crenels; and a first spacer plate that is positioned between the front plate and back plate when the bezel material is tensioned between the plurality of first merlons and first crenels and the plurality of second merlons and second crenels.

12. The device of claim 11, wherein the first merlons form a first merlon surface, and wherein each first crenel is substantially perpendicular to the first merlon surface.

13. The device of claim 11, further comprising an alignment stud that extends through at least one of the front plate and back plate when the bezel material is tensioned between the plurality of first merlons and first crenels and the plurality of second merlons and second crenels.

14. The device of claim 11, wherein the alignment stud is threadedly coupled to at least one of the front plate and back plate.

15. The device of claim 11, wherein the first merlons form a first merlon surface, wherein the first spacer plate comprises a first supporting edge, and wherein the first supporting edge is positioned below the first merlon surface when the bezel making material is tensioned between the plurality of first merlons and first crenels and the plurality of second merlons and second crenels.

16. The device of claim 11, further comprising a second spacer plate that is positioned between the front plate and back plate when the bezel material is tensioned between the plurality of first merlons and first crenels and the plurality of second merlons and second crenels, wherein the first spacer plate comprises a first thickness dimension (TD1), wherein the second spacer plate comprises a second thickness dimension (TD2), and wherein there is greater than a five percent difference between TD1 and TD2.

17. The device of claim 11, wherein the front plate comprises a third crenellated edge, the third crenellated edge having a plurality of third merlons and third crenels, and wherein the back plate comprises a fourth crenellated edge, the fourth crenellated edge having a plurality of fourth merlons and fourth crenels.

18. The device of claim 17, wherein the first crenels are not linearly aligned with the third crenels.

* * * * *